US006631982B2

(12) United States Patent
Sasaki et al.

(10) Patent No.: US 6,631,982 B2
(45) Date of Patent: Oct. 14, 2003

(54) LIQUID EJECTING APPARATUS

(75) Inventors: Toshihiro Sasaki, Kanagawa (JP); Yutaka Koizumi, Kanagawa (JP); Akihiro Yamanaka, Kanagawa (JP); Hiroyuki Maeda, Kanagawa (JP); Akira Goto, Kanagawa (JP); Hiroki Tajima, Kanagawa (JP); Yasushi Iijima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/067,880

(22) Filed: Feb. 8, 2002

(65) Prior Publication Data

US 2002/0113851 A1 Aug. 22, 2002

(51) Int. Cl.[7] ..... B41J 2/175
(52) U.S. Cl. ..... 347/85; 347/86
(58) Field of Search ..... 347/85, 86, 87

(56) References Cited

U.S. PATENT DOCUMENTS

| | | | | |
|---|---|---|---|---|
| 4,700,202 A | * | 10/1987 | Kuranishi et al. | 347/86 |
| 5,278,584 A | | 1/1994 | Keefe et al. | 347/63 |
| 5,777,646 A | | 7/1998 | Barinaga et al. | 347/86 |
| 5,815,182 A | | 9/1998 | Otis et al. | 347/85 |
| 5,949,456 A | | 9/1999 | Matsumoto et al. | 347/85 |
| 5,949,458 A | * | 9/1999 | Studholme | 347/86 |
| 5,975,677 A | * | 11/1999 | Marler et al. | 347/40 |
| 5,980,031 A | | 11/1999 | Sasaki et al. | 347/85 |
| 6,079,823 A | * | 6/2000 | Droege | 347/85 |
| 6,086,193 A | * | 7/2000 | Shimada et al. | 347/86 |
| 6,179,416 B1 | | 1/2001 | Ikeda et al. | 347/86 |

FOREIGN PATENT DOCUMENTS

| | | |
|---|---|---|
| JP | 9-174876 | 7/1997 |
| JP | 9-187967 | 7/1997 |
| JP | 2000-15828 | 1/2000 |
| JP | 2001-88318 | 4/2001 |

* cited by examiner

*Primary Examiner*—Anh T.N. Vo
(74) *Attorney, Agent, or Firm*—Fitzpatrick, Cella, Harper & Scinto

(57) ABSTRACT

In a liquid ejecting apparatus in which ink is supplied from an ink tank to a print cartridge detachably mounted on a carriage through a tube, connection between an ink needle at a tube side and an interconnecting member at a cartridge side can sealingly be effected positively, and ink supplying and connecting means can be made compact. A closing film having a small hole and a central slit is provided at a tip end of an interconnecting member made of soft material and fitted into an ink flow-in projection portion of the print cartridge into which an ink needle is inserted. Further, a notched needle tip end avoiding configuration is provided at a lower part of a tip end of the projection portion so that abutment between the projection portion and the ink needle can be avoided when the print cartridge is mounted and dismounted, thereby reducing a shifting amount of a needle holding member.

14 Claims, 10 Drawing Sheets

LIQUID EJECTING APPARATUS

BACKGROUND OF THE INVENTION

1. Field of the Invention

The present invention relates to an ink supplying system in a liquid ejecting apparatus, and more particularly, it relates to a liquid ejecting apparatus including an ink supplying system capable of detachably connecting and communicating an ink needle to be connected to a tube side so that ink can be supplied from an ink tank to a discharge head portion of a print cartridge via a tube, with an interconnecting member of the print cartridge side.

2. Related Background Art

Image recording apparatuses such as printers, copiers, facsimiles and the like are designed so that an image formed on a recording medium such as paper, a thin plastic plate and the like on the basis of image information, and such image recording apparatuses can be divided into an ink jet type, a wire dot type, a thermal type, a laser beam type and the like. Among them, a liquid ejecting apparatus of ink jet type is designed to effect recording by discharging liquid such as ink from a discharge head (liquid ejecting head) toward the recording medium and has advantages that a highly fine image can be recorded, that it has less noise because of non-impact type and that a color image can easily be recorded by using plural color inks.

In the liquid ejecting apparatus, the image is recorded by the discharge head detachably mounted on a carriage shifted in a scanning direction along the recording medium, and, after one-line recording, predetermined feed of the recording medium is effected (in a sub-scanning direction), and thereafter, an image corresponding to a next line is recorded on the recording medium now stationary, and, by repeating such operations, the recording is effected on the entire recording medium.

Such conventional liquid ejecting apparatuses are grouped into a type in which an ink tank storing the ink therein is mounted on the carriage together with the liquid discharge head and a type in which the ink tank is disposed at an appropriate place different from the carriage and the ink in the ink tank is supplied to the liquid discharge head through a piping (tube).

In the former type, since the ink tank is mounted on the carriage together with the liquid discharge head, the ink supplying system has a relatively simple construction, but capacity (weight) of the ink tank is limited. Particularly, in a printer adaptable to recent photo-images, in many cases, since six color inks are used (ink having low density is added), a tank capacity for each color becomes smaller. Thus, the ink tanks must be replaced or exchanged frequently.

On the other hand, in the latter type, although an ink supplying system for supplying the ink from the ink tank to the liquid discharge head is required and thus the construction of the ink supplying system becomes complicated, since the ink tank can be located at any appropriate place of a main body of the apparatus, there is no problem even when the capacity (weight) of the ink tank is increased, and, thus, this type is inevitable for a large-sized liquid injecting apparatus. Further, cost of ink per unit volume is reduced, and running cost is reduced.

In this way, in the liquid ejecting apparatus of type in which the ink tank is arranged out of the carriage and the ink in the ink tank is supplied to the liquid discharge head through the tube of the ink supplying system, by providing a print cartridge having only one color discharge head and a sub-tank (ink reservoir) and by detachably mounting the print cartridge to the carriage, connection of the ink supplying system is effected.

When the print cartridge is designed for each color, although a mounting force to the carriage is reduced, since a length of each side of the print cartridge is small, it is difficult to enhance positioning accuracy with respect to the carriage, thereby worsening print quality, and, since discrete structures are required for respective colors, a distance between the liquid discharge heads cannot be reduced, and, thus, in order to effect the printing on a predetermined area or range, a shifting range of the carriage must be increased. As a result, a size of the main body of the apparatus is increased and through-put is reduced.

In order to solve such problems, it is preferable that the print cartridge is designed for plural colors. However, in the construction in which the print cartridge is designed for plural colors, joint structures of plural ink supplying systems for supplying inks from the respective color ink tanks to the respective liquid discharge heads of the print cartridge are required, and means for mounting the print cartridge on the carriage and for securing the print cartridge to the carriage and means for connecting the respective joint structures to permit to supply the inks to the secured print cartridge are required. Thus, when the print cartridge is mounted and dismounted with respect to the carriage, the respective joint structures of the ink supplying systems must be retarded greatly not to interfere with the mounting and dismounting of the print cartridge, and, thus, an arrangement for shifting the joint structures becomes bulky and not only arrangement and part for effecting the shifting but also the main body of the apparatus itself becomes bulky.

Further, in a case where such joint structures are included, when the print cartridge is mounted and dismounted with respect to the carriage, the ink in the joint portions may be scattered into the interior and/or exterior of the apparatus, thereby contaminating the usage environment and reducing the reliability of the main body of the apparatus.

SUMMARY OF THE INVENTION

The present invention is made in consideration of the above-mentioned conventional problems, and an object of the present invention is to provide a liquid ejecting apparatus having an ink supplying system for supplying ink from an ink tank to a print cartridge detachably mounted on a carriage through a tube, in which connection and communication between an ink needle connected to a tube side and an interconnecting member of a print cartridge side can be sealingly effected positively with high accuracy and ink supplying and connecting means can be made small-sized and a main body of the apparatus can also be made compact.

To achieve the above object, the present invention provides a liquid ejecting apparatus wherein a print cartridge having a discharge head portion for discharging a liquid droplet is detachably mounted on a carriage, and the apparatus comprises an ink supplying and connecting mechanism for detachably connecting and communicating an ink needle connected to a tube side and an interconnecting member of a print cartridge side in order that ink can be supplied from an ink tank to the print cartridge through a tube, and further wherein the print cartridge comprises the discharge head portion for discharging the liquid droplet in response to a received electrical signal, a sub-tank for temporarily storing the ink to be supplied to the discharge head portion and a cartridge body portion for forming an ink flow path for connecting the sub-tank to the discharge head portion, and an ink flow-in member having a cylindrical projection portion into which the interconnecting member formed from soft material for receiving the ink from the ink tank is fitted by inserting the ink needle connected to the tube side, and a closing film having a small hole and a slit is formed at an ink needle inserting tip end of the interconnecting member.

In the liquid ejecting apparatus of the present invention, the small hole of the interconnecting member preferably has an inner diameter smaller than an outer diameter of the ink needle, and it is preferable that a length of the small hole of the interconnecting member in an ink needle inserting direction is equal to or greater than 1 mm and a thickness of the closing film is equal to or greater than 0.2 mm and equal to or smaller than 1 mm. Further, an ink needle inserting tip end of the small hole of the interconnecting member is preferable tapered.

In the liquid ejecting apparatus of the present invention, it is preferable that a needle tip end avoiding configuration is provided at a tip end of the cylindrical projection portion of the ink flow-in member, and it is also preferable that the ink flow-in member has a flat plate-shaped portion joined to the cartridge body portion to form the ink flow path to the sub-tank and the flat plate-shaped portion is joined to the cartridge body portion by vibration welding.

In the liquid ejecting apparatus of the present invention, it is preferable that the ink needle is held by a needle holding member shiftably provided on the carriage so that the ink needle can be insertion-connected to and detached from the interconnecting member of the print cartridge, and it is also preferable that the needle holding member is shifted toward and away from the print cartridge by a needle shafting lever rotatably supported on the carriage.

In the liquid ejecting apparatus of the present invention, it is preferable that the ink flow-in member is provided with a plurality of interconnecting members and a plurality of ink needles are provided in correspondence to the respective interconnecting members.

In the liquid ejecting apparatus of the present invention, it is preferable that, when the ink needles are inserted into and connected to the interconnecting members of the print cartridge, the ink needles penetrate into the slits of the closing films in a condition that the ink needles are sealed by the small holes of the interconnecting members.

In the liquid ejecting apparatus of the present invention, it is preferable that, when the ink needles are dismounted from the interconnecting members of the print cartridge, the ink needles are passed through the slits of the closing films in a condition that the ink needles are sealed by the small holes of the interconnecting members.

According to the present invention, by fitting the cylindrical interconnecting member made of rubber or soft resin and including the closing film having, at its tip end, the small hole and the slit for receiving the ink needle into the cylindrical projection portion constituting the ink flow-in member provided on the print cartridge and by vibration-welding (ultrasonic welding and the like) the ink flow-in member to the print cartridge body, connecting means of the ink supplying system can be manufactured with a simple construction, and, by forming the closing film having the slit and small hole having the inner diameter smaller than the outer diameter of the ink needle on the interconnecting member, when the ink needle is inserted, the sealing can be maintained by face contact between an outer surface of the ink needle and an inner surface of the small hole, and, when the ink needle is detached, flow-out of the ink in the print cartridge and entering of dirt from outside can be prevented. In this way, with a simple construction, communication of the ink supplying system by connection between the interconnecting member and the ink needle can be achieved sealingly and positively with high accuracy. Further, in this case, since the ink needles are inserted into and retracted from the slits of the closing films in the condition that the ink needles are sealed by the small holes of the interconnecting members, the ink is not scattered into the interior and/or exterior of the apparatus.

Further, by providing the notched ink needle tip end avoiding configuration for avoiding contact between the tip end of the ink needle and the ink flow-in member at the tip end of the cylindrical projection portion of the ink flow-in member in the print cartridge, a shifting amount of the needle holding member which was required when the print cartridge is mounted and dismounted can be reduced, and the structure for shifting the needle holding member and the printer body can be made compact.

BRIEF DESCRIPTION OF THE DRAWINGS

FIG. 3A is an enlarged sectional view of the ink flow-in member, FIG. 3B is a left side view of the interconnecting member, and FIG. 3C is a view showing a relationship between the interconnecting member and an ink needle;

FIG. 4A is a view where the ink needle is separated from the interconnecting member, FIG. 4B is a view where the ink needle is passing a small hole of the interconnecting member, and FIG. 4C is a view where the ink needle is mounted to the interconnecting member;

DESCRIPTION OF THE PREFERRED EMBODIMENTS

The present invention will now be explained in connection with embodiments thereof with reference to the accompanying drawings.

Figure 1:
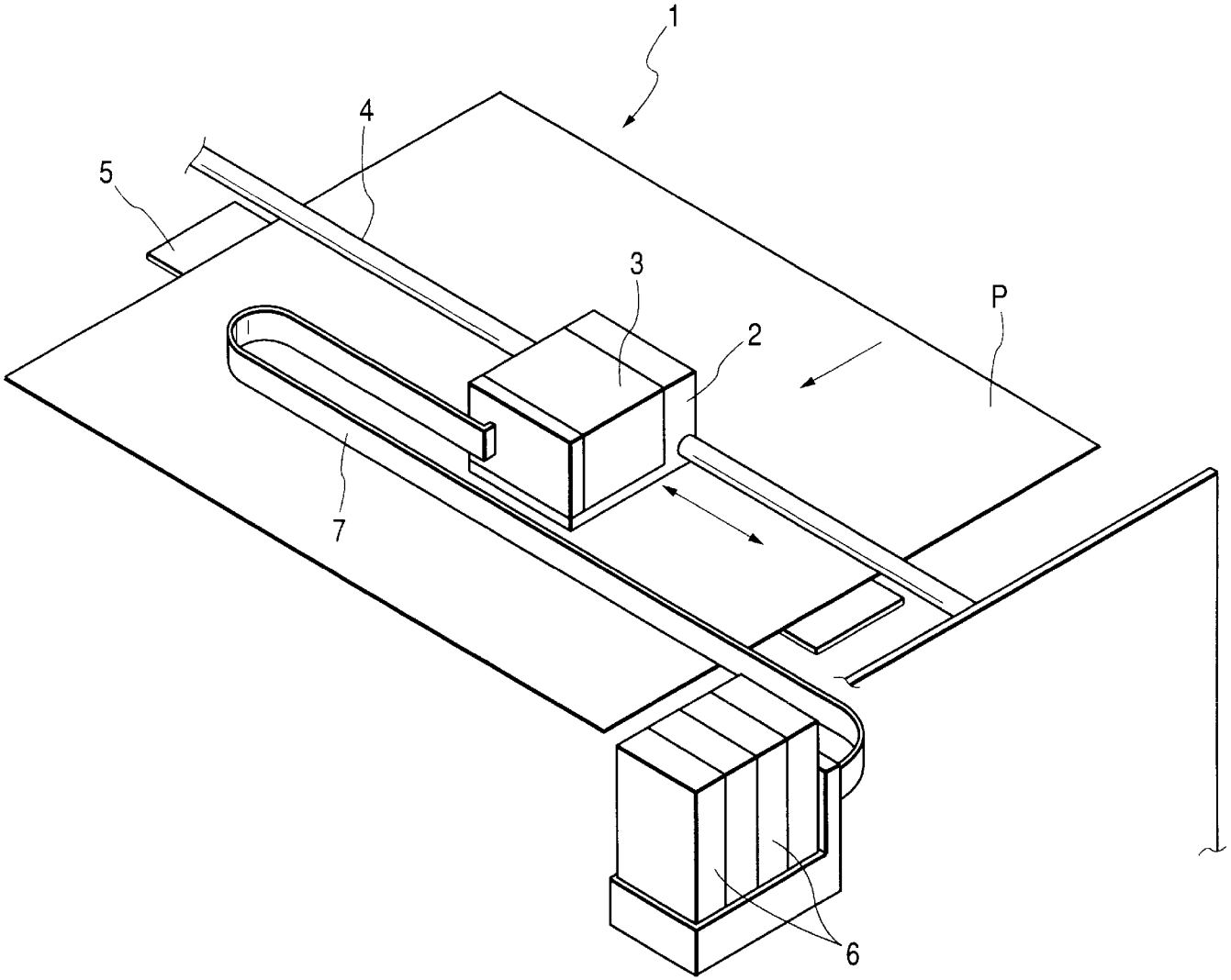
FIG. 1 is a schematic constructural view showing a liquid ejecting apparatus according to the present invention.
Figure 2A:
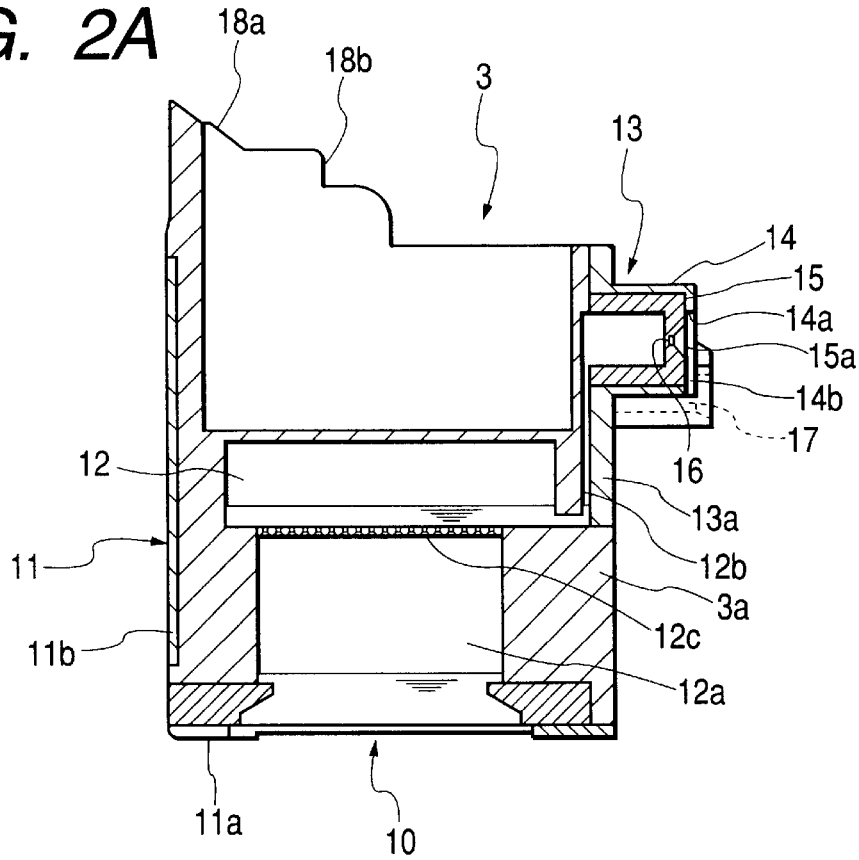
FIGS. 2A and 2B are sectional and right side views, respectively, showing a construction of a print cartridge of the liquid ejecting apparatus of the present invention.
Figure 2B:
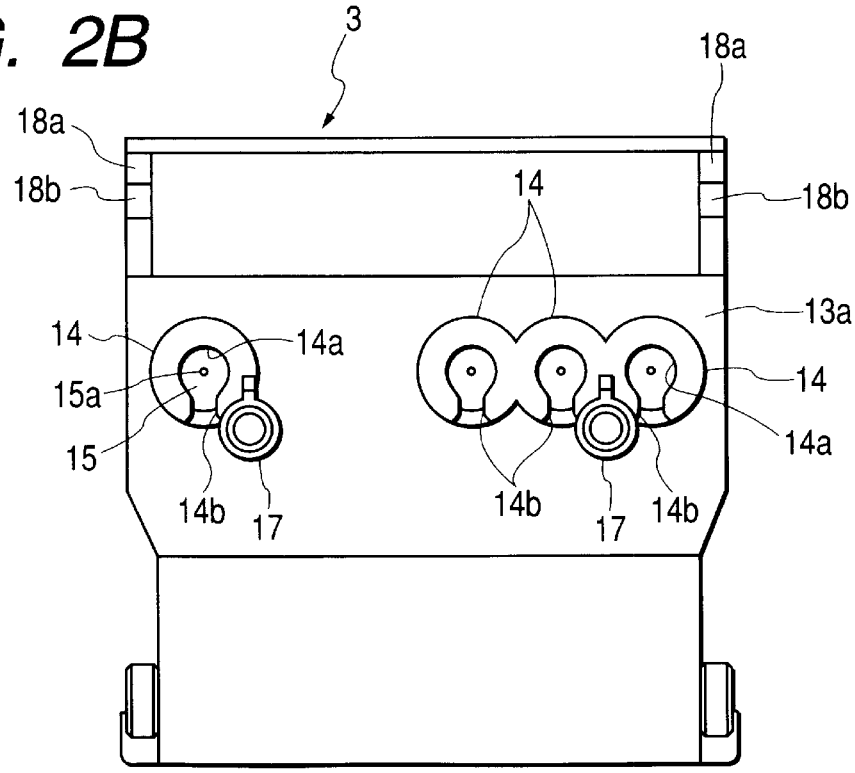
Figure 3A:
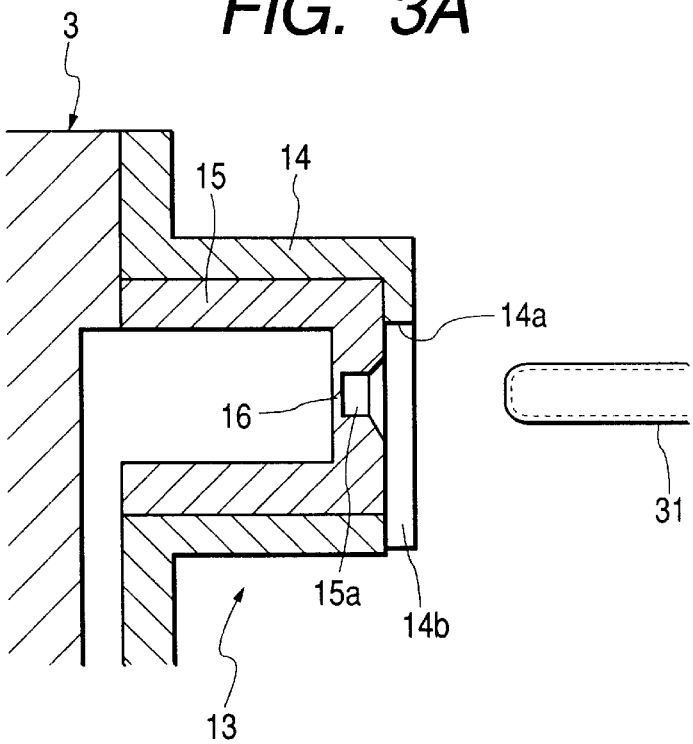
FIGS. 3A, 3B and 3C are views for explaining an interconnecting member of an ink flow-in member in the print cartridge of the present invention, where
Figure 3B:
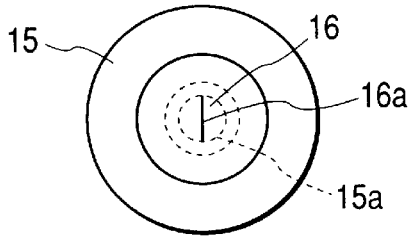
Figure 3C:
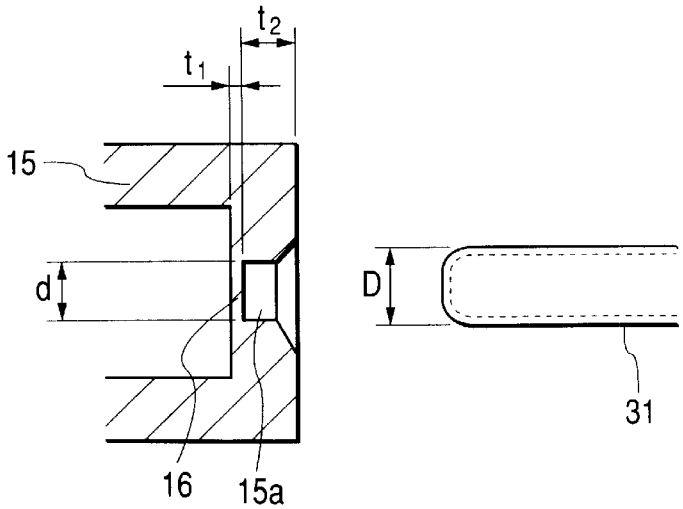
Figure 4A:
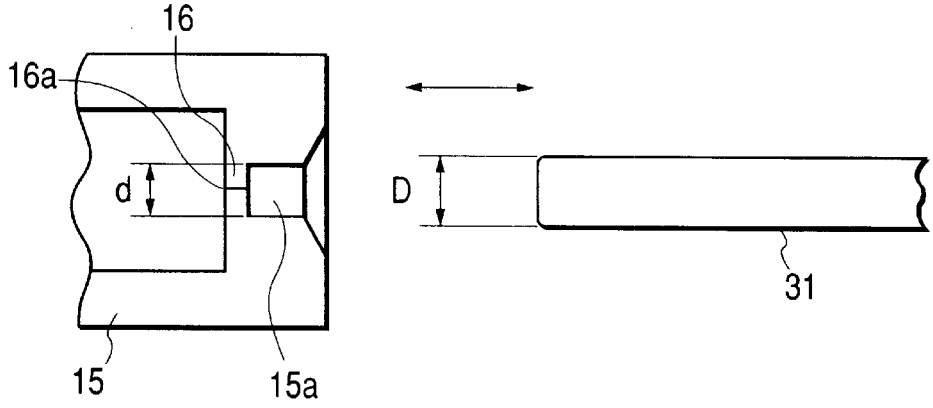
FIGS. 4A, 4B and 4C are views for showing steps of mounting/dismounting the ink needle with respect to the interconnecting member of the present invention, where
Figure 4B:
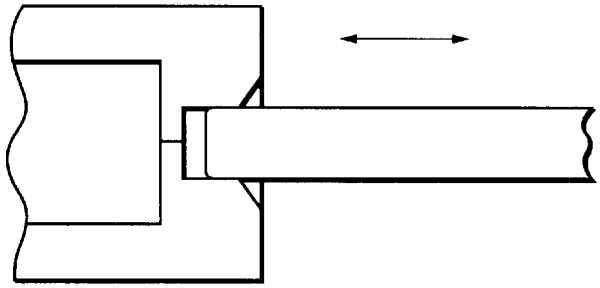
Figure 4C:
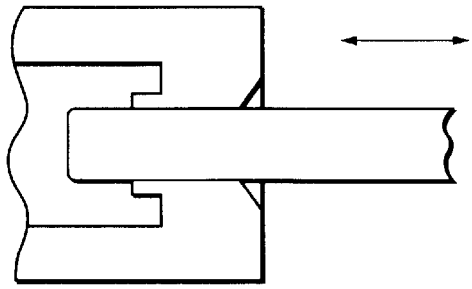
Figure 5:
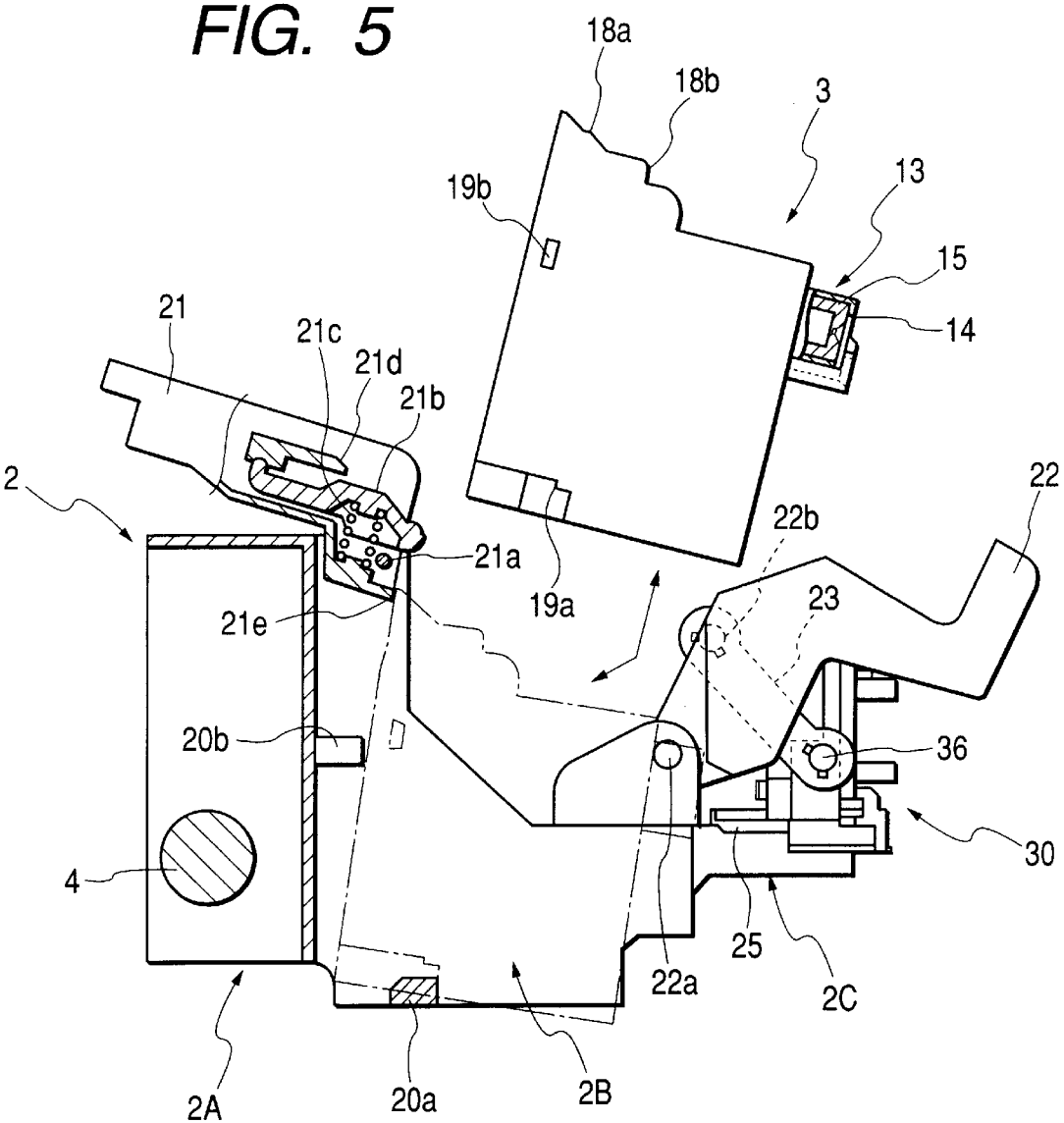
FIG. 5 is a schematic constructural view of a carriage of the liquid ejecting apparatus of the present invention, showing a detachable condition of the print cartridge.
Figure 6A:
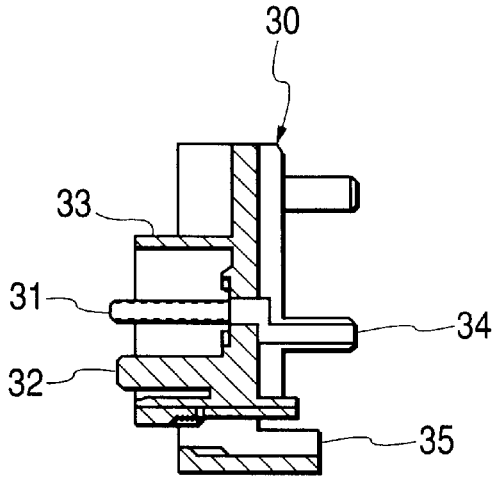
FIG. 6A is a longitudinal sectional view of a needle holding member mounted on the carriage of the liquid ejecting apparatus of the present invention.
Figure 6B:
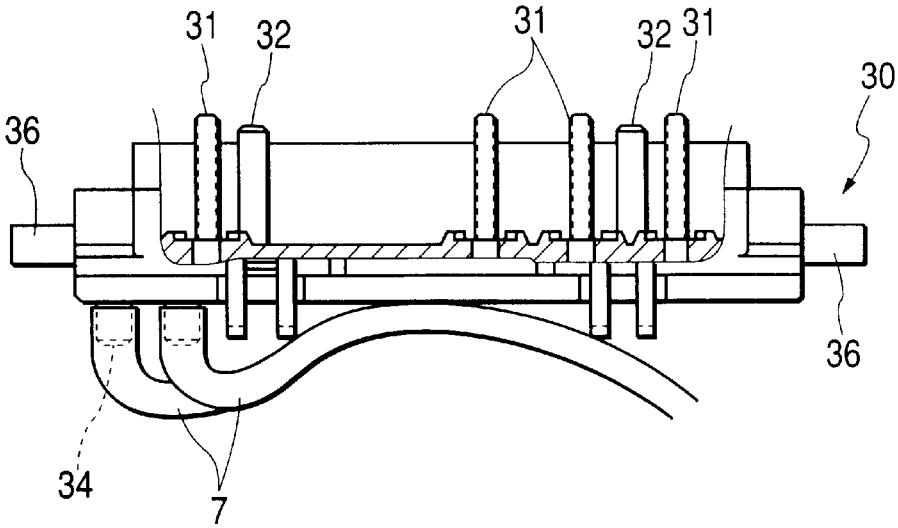
FIG. 6B is a partial sectional view of the needle holding member.

FIG. 1 is a schematic constructural view showing a liquid ejecting apparatus according to the present invention, FIGS. 2A and 2B are sectional and right side views, respectively, showing a construction of a print cartridge of the liquid ejecting apparatus of the present invention, FIGS. 3A to 3C are views for explaining an interconnecting member of an ink flow-in member in the print cartridge of the present invention, where FIG. 3A is an enlarged sectional view of the ink flow-in member, FIG. 3B is a left side view of the interconnecting member, and FIG. 3C is a view showing a relationship between the interconnecting member and an ink needle, FIGS. 4A to 4C are views for showing steps of mounting/dismounting the ink needle with respect to the interconnecting member of the present invention, where FIG. 4A is a view where the ink needle is separated from the interconnecting member, FIG. 4B is a view where the ink needle is passing a small hole of the interconnecting member, and FIG. 4C is a view where the ink needle is mounted to the interconnecting member, FIG. 5 is a schematic constructural view of a carriage of the liquid ejecting apparatus of the present invention, showing a detachable condition of the print cartridge, and FIG. 6A is a longitudinal sectional view of a needle holding member mounted on the carriage of the liquid ejecting apparatus of the present invention, and FIG. 6B is a plan view, in partial section, of the needle holding member.

In a liquid ejecting apparatus 1 shown in FIG. 1, a print cartridge 3 including a discharge head portion (not shown in FIG. 1) having a plurality of liquid discharge ports is detachably mounted on a carriage 2, and the carriage 2 is slidably mounted on a guide shaft 4 and is driven by driving means (not shown) to shift the print cartridge 3 in a main scanning direction. A platen board 5 for holding a recording medium P such as print paper is disposed at a lower position opposed to the print cartridge 3, and the recording medium P held by the platen board 5 is successively conveyed in a sub-scanning direction by a feed roller and the like (not shown) as medium conveying means. Further, a plurality of ink tanks 6 are disposed at one side of a frame and are connected to the print cartridge 3 through ink supplying tubes 7. In FIG. 1, four ink tanks 6 are provided, and different color inks (four color (for example, black, yellow, magenta and cyan) inks) are contained in the ink tanks 6 and are supplied to liquid discharge ports of discharge head portions of the print cartridge 3 through the ink supplying tubes 7 connected to the respective ink tanks 6.

As shown in FIGS. 2A and 2B, the print cartridge 3 detachably mounted on the carriage 2 is constituted by a discharge head portion 10 having a plurality of sets of liquid discharge ports and liquid flow paths and recording elements and designed to discharge liquid droplets from the respective liquid discharge ports in response to recording data, a sub tank 12 communicated with the discharge head portion 10 and adapted to temporarily store liquid, a cartridge body portion 3*a* having an ink flow path 12*a* for supplying ink stored in the sub tank 12 and an ink flow-in groove 12*b* for flowing the ink into the sub tank 12, an ink flow-in member 13 for receiving the ink supplied from the ink tanks 6 and for flowing the ink into the sub tank 12, and a wiring substrate 11 for inputting an electrical signal from outside into the discharge head portion 10, and a filter 12*c* is disposed between the sub tank 12 and the ink flow path 12*a*.

The ink flow-in member 13 has a flat plate-shaped portion 13*a* for covering one face of the ink flow-in groove 12*b* for flowing the ink into the sub tank 12 to form the ink flow path, and a plurality (four in the illustrated embodiment) of cylindrical projection portion 14 arranged in a line, and the flat plate-shaped portion 13*a* is joined to one face of the body portion 3*a* of the print cartridge 3 by vibration welding (ultrasonic welding) and the like to be integrally formed with the print cartridge 3. The plurality of cylindrical projection portions 14 are provided with at their tip ends with holes 14*a* having diameters greater than outer diameters of ink needles 31 of a needle holding member 30 which will be described later so as to permit insertion of the ink needles 31, and needle tip end avoiding configurations 14*b* partially notched are formed in lower portions of peripheries of the holes 14*a*. By providing such needle tip end avoiding configurations 14*b*, when the print cartridge 3 is mounted and dismounted with respect to the carriage 2, tip ends faces of the projection portions 14 can be escaped not to abut against the tip ends of the ink needles 31, thereby reducing a shifting amount (avoiding amount) of the needle holding member 30 (FIGS. 5 and 7A and 7B) for holding the ink needles 31, and, thus, contributing to compactness of the carriage and accordingly compactness of the apparatus (refer to FIGS. 7A and 7B).

Further, a cylindrical interconnecting member 15 formed from rubber or soft resin is fitted into each cylindrical projection portion 14, and, as shown in FIGS. 3A to 3C, the interconnecting member 15 is provided at its one end with a small hole 15*a* having a diameter (d) smaller than the outer diameter (D) of the ink needle 31, and an ink needle inserting end of the small hole 15*a* is tapered. Further, a closing film 16 is disposed at an end of the small hole 15*a* remote from the ink needle inserting end, and, as shown in FIG. 3B, the closing film 16 has a single slit or plural slits 16*a* in a range corresponding to the inner diameter of the small hole 15*a*.

By constructing the interconnecting members 15 in this way, when the ink needles 31 are inserted into the interconnecting members 15, the ink needles 31 are passed while widening the small holes 15*a* of the interconnecting members 15 and are inserted while widening the slits 16*a* of the closing members 16. When each ink needle 31 is inserted into the corresponding small hole 15*a*, face contact between an outer surface of the ink needle and an inner surface of the small hole 15*a* maintains the sealing. Here, it is preferable that a length $t_2$ of the small hole 15*a* is equal to or greater than 1 mm to maintain the face contact between the small hole and the ink needle 31. Further, by providing the closing film 16 having the slits 16*a*, when the ink needles 31 are disconnected from the interconnecting members 15, the slits 16*a* of the closing films 16 are returned to their original conditions by elastic forces to close the small holes, with the result that the ink temporarily stored in the sub tank 12 of the cartridge body portion 3*a* can form meniscus in the liquid discharge ports to prevent the ink from flowing out of the liquid discharge ports and to prevent flow-out and drying of the ink and to prevent dirt from out side from the entering into the discharge ports, and, thus, leakage of ink can be prevented even in a condition that the print cartridge 3 is dismounted from the carriage 2. Here, since a thickness ($t_1$) of each closing film 16 affects a great influence upon reliability for inserting the ink needles 31 and for maintaining the meniscus, in the illustrated embodiment, by selecting the thickness ($t_1$) to be equal to or greater than 0.2 mm and equal to or smaller than 1 mm, both functions can be satisfied. Further, in the slits 16*a* formed in the closing films 16, although it is afraid that cracks may be created at ends of the slits 16 when the ink needles 31 are inserted and disconnected, since the slits 16*a* are formed in the range corresponding to the inner diameter of each small hole 15*a* smaller than the outer diameter of the corresponding ink needle 31, the cracks are not created.

By providing the taper at the ink needle inserting end of each small hole 15*a*, when the ink needle 31 is inserted into the small hole, the tip end of the ink needle can always be directed into the small hole 15*a*, and leakage of ink due to deformation of the interconnecting member 15 which may be caused by positional deviation of insertion of the ink needle 31 can be eliminated.

Next, the mounting and dismounting of the ink needles 31 with respect to the interconnecting members 15 will be explained with reference to FIGS. 4A to 4C.

When the ink needles 31 are connected to the interconnecting members 15, steps shown in FIGS. 4A to 4C are effected. FIG. 4A shows a condition that the ink needles 31 are not connected. Then, as shown in FIG. 4B, the ink needles 31 are passed through the small holes 5*a* of the interconnecting members 15 while widening the small holes, and, when the ink needles 31 are inserted into the small holes 15*a*, the sealing is ensured by face contact between outer surfaces of the ink needles 31 and inner surfaces of the small holes 15*a*. Then, as shown in FIG. 4C, the ink needles are inserted while widening the slits 16*a* of the closing films 16. Since the slits 16*a* of the closing films 16 are widened in the condition that the small holes 15*a* are sealed in this way, when the ink needles 31 are connected to the interconnecting members 15, the ink can be prevented from scattering outside.

Further, when the ink needles 31 are disconnected from the interconnecting members 15, reverse steps shown in FIGS. 4C, 4B and 4A are effected. In this case, FIG. 4C shows a mounted condition. As shown in FIG. 4B, in the course that the ink needles 31 are being retracted, first of all, the slits 16*a* of the closing films 16 are returned to their original conditions by the elastic force to close the ink outlets, thereby shielding the ink from the exterior. In this case, the side surfaces of the ink needles 31 are sealed by the face contact between the ink needles and the inner surfaces of the small holes 15*a*. Then, as shown in FIG. 4A, after the closing films 16 are completely closed, the ink needles 31 are retracted from the interconnecting members 15. Since the slits 16*a* of the closing films 16 are closed by the elastic force in the condition that the small holes 15*a* are sealed or closed, when the ink needles 31 are disconnected from the interconnecting members 15, the ink can be prevented from scattering outside.

In the illustrated embodiment, the ink needles 31 are cylindrical, and the outer diameter (D) of the ink needles 31 is greater than the diameter (d) of the small hole 15*a* of the interconnecting member 15, and the ink needle inserting end of the small hole 15*a* is tapered. In the illustrated embodiment, the diameter (d) of the small hole 15*a* is selected to 2.3 mm and the outer diameter (D) of the ink needle 31 is selected to 2.6 mm. From tests for confirming the effects with the diameter (d) 2.2 mm to 2.4 mm and the diameter (D)=2.5 mm to 2.7 mm, it was found that the mounting and dismounting can be repeated with scattering the ink.

As shown in FIGS. 2A and 2B, the ink flow-in member 13 is provided with a plurality (two in the illustrated embodiment) of guiding boss holes 17 for effecting guiding and positioning when the ink needles 31 are inserted into the interconnecting members 15, and these boss holes correspond to guiding bosses 32 provided on the needle holding member 30.

On upper surfaces of left and right side walls of the body portion 3*a* of the print cartridge 3, there are provided inclined surfaces 18*a* and lock surfaces 18*b* (having any inclined angles) to be engaged by set plates 21*a* of head set levers 21 (described later) when the print cartridge 3 is mounted on the carriage 2 in order that the print cartridge can be shifted and positioned at a predetermined mounting position on the carriage as the head set levers 21 are rotated.

An electrical wiring 11*a* for applying an electrical signal for causing the discharge head portion 10 comprised of a plurality of liquid discharge ports, liquid flow paths and recording elements to discharge the ink, and an external signal inputting terminal 11*b* disposed at an end of the electrical wiring and adapted to receive an electrical signal from the main body are provided on a surface of the wiring substrate 11 opposite to the ink flow-in member 13 of the cartridge body portion 3*a*.

Next, the carriage 2 will be explained with reference to FIG. 5 and FIGS. 6A and 6B.

The carriage 2 comprises a attaching portion 2A slidably attaching the carriage to the guide shaft 4, a cartridge housing portion 2B formed for mounting and positioning the print cartridge 3, and a needle mounting portion 2C for slidably mounting the needle holding member 30, and the head set levers 21 for setting the print cartridge 3 at a predetermined mounting position of the cartridge housing portion 2B are rotatably supported by upper parts of both side walls of the carriage 2 for rotating movement around shafts 21*a*, and a needle shifting lever 22 for sliding the needle holding member 30 is rotatably supported for rotation around a shaft 22*a* in the vicinity of the needle mounting portion 2C. Further, the cartridge housing portion 2B of the carriage 2 is provided with a positioning member 20*a* and a positioning piece 20*b* for positioning the print cartridge 3 at the mounting position, and, correspondingly, the print cartridge 3 is provided with a positioning face 19*a* for abutting against the positioning member 20*a* and a positioning portion 19*b* for abutting against the positioning piece 20*b*, so that the print cartridge 3 can be mounted and positioned at the predetermined mounting position of the cartridge housing portion 2B of the carriage 2 more positively with high accuracy.

Figure 9A:
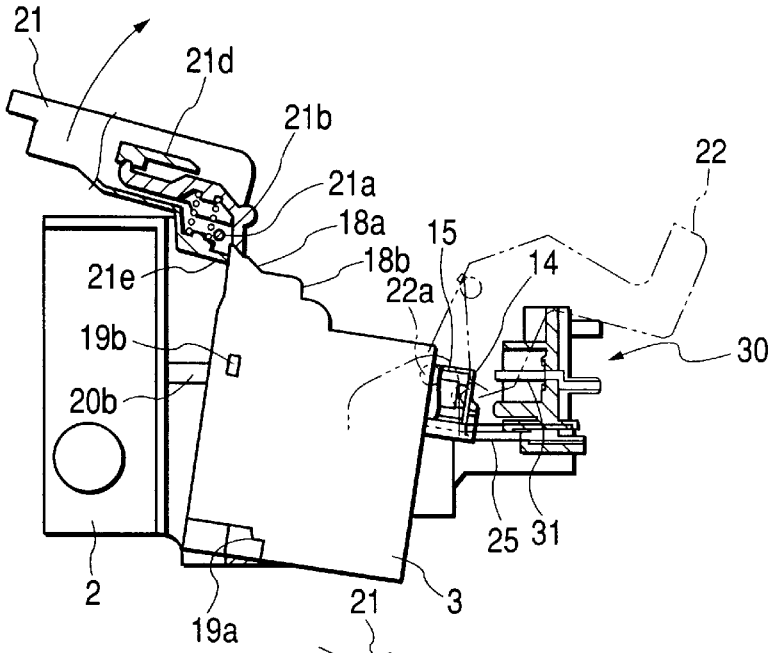
FIGS. 9A, 9B and 9C are schematic view showing sequence for mounting the print carriage in a print cartridge mounting and dismounting procedure with respect to the carriage in the liquid ejecting apparatus of the present invention.
Figure 9B:
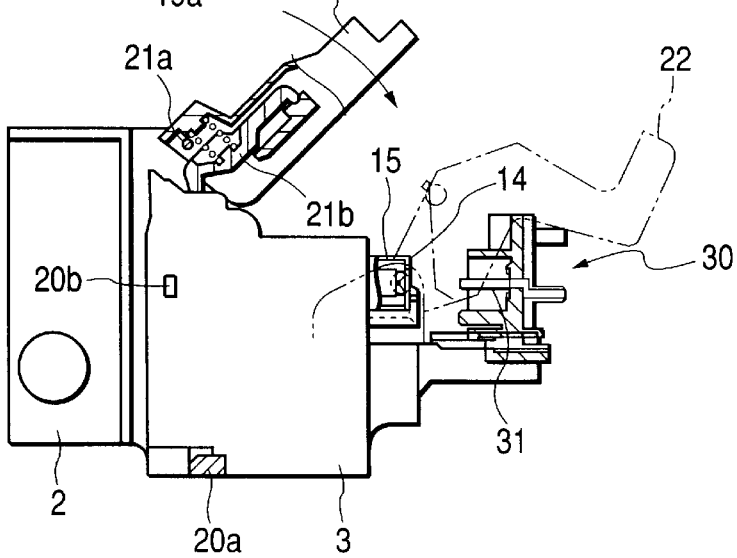
Figure 9C:
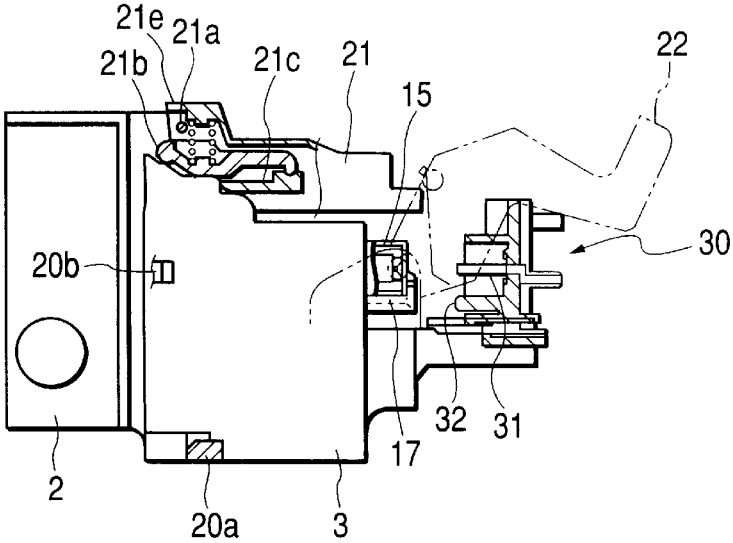

The head set levers 21 are rotatably attached to the carriage 2 for rotational movement around the shafts 21*a*, and a lock plate 21*d* and an urging piece 21*e* are formed on parts of each head set lever, and a head set plate 21*b* biased by a spring 21*c* is incorporated into each head set lever. The head set plates 21*b* abut against and engage with the inclined surfaces 18*a* of the print cartridge 3 to apply forces toward a direction along which the print cartridge 3 is guided and fixed in the predetermined mounting position. By rotating the head set levers 21 having such construction around the shafts 21*a*, as shown in FIGS. 9A to 9C, the print cartridge 3 can be guided and shifted to the predetermined mounting position on the carriage 2. Further, when the print cartridge 3 is dismounted from the carriage 2, the urging pieces 21*e* of the head set levers 21 abut against the upper surfaces of the side walls of the print cartridge 3, thereby pushing the print cartridge out of the predetermined mounting position.

The needle mounting portion 2C on which the needle holding member 30 is slidably mounted is disposed at the right of the cartridge housing portion 2B in FIG. 5, and a pair of guide bodies 25 are provided for permitting the sliding movement of the needle holding member 30 in a left-and-right direction.

As shown in FIGS. 6A and 6B, the needle holding member 30 includes a plurality (four in the illustrated embodiment) of hollow ink needles 31 (corresponding to the interconnecting members 15 of the print cartridge 3) to be inserted into the interconnecting members 15 of the ink flow-in member 13 of the print cartridge 3 thereby to permit the supplying of the ink, and a plurality of connecting members 34 to which the ink supplying tubes 7 connected to the ink tanks 6 are connected are provided on the other surface of the holding member. The connecting members 34 are communicated with the ink needles 31 through ink flow paths (not shown) formed in a body of the needle holding member 30. By forming the ink flow paths in the body of the needle holding member 30 in this way, the plural ink needles 31 and the plural connecting members 34 can appropriately be located at any positions, so that the connection of the respective color ink needles 31 to the plural interconnecting members 15 of the print cartridge 3 can be facilitated and bending area for the plural ink supplying tubes 7 connected to the plural connecting members 34 can appropriately be reserved, thereby contributing to compactness of the main body of the apparatus.

Further, the needle holding member 30 is provided with sliding members 35 engaged by the pair of guide bodies 25 provided on the needle mounting portion 2C of the carriage 2 so that the sliding members can be shifted in the left-and-right direction along the guide bodies 25, and shaft portions 36 protruding outwardly are provided on both side surfaces of the needle holding member 30. As shown in FIG. 5, one end of a link 23 rotatably attached to the needle shifting lever 22 via a shaft 22*b* is rotatably attached to the shaft portions 36. Further, the plurality of guiding bosses 32 are provided in correspondence to the plural (two) guiding boss holes of the ink flow-in member 13 of the print cartridge 3, and a guide cover 33 serves to protect the ink needles 31 and shift along the projection portions 14 to guide the shifting movements of the ink needles 31 when the ink needles 31 are inserted into the interconnecting members 15 of the ink flow-in member 13.

Figure 8A:
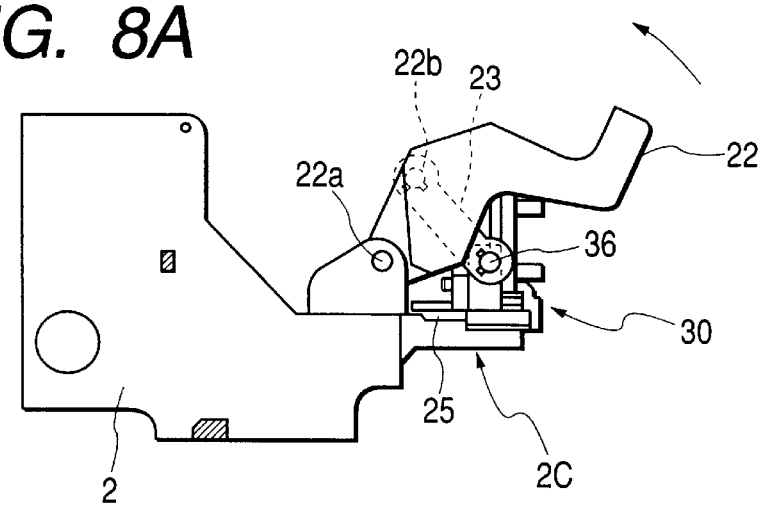
FIGS. 8A, 8B and 8C are views showing a relationship between a needle holding member and a needle shifting lever in the carriage of the liquid ejecting apparatus of the present invention.
Figure 8B:
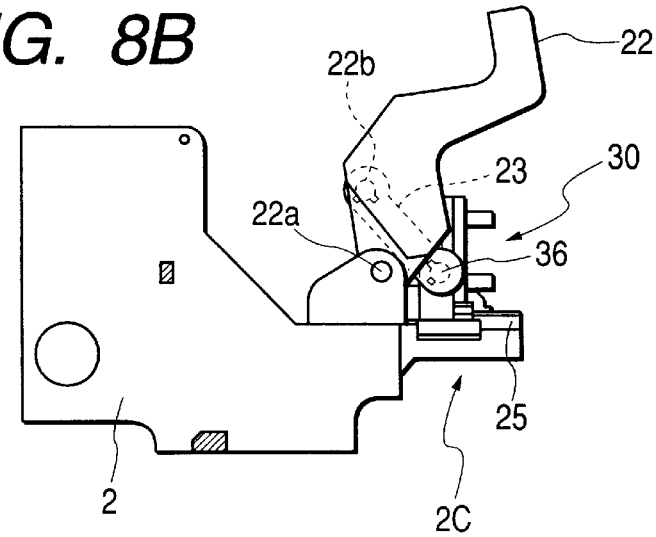
Figure 8C:
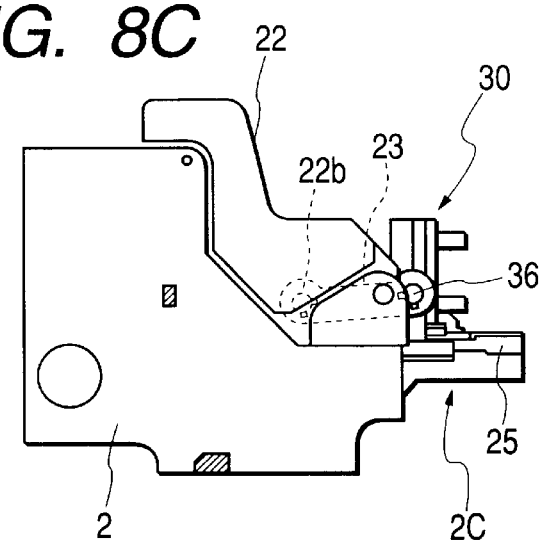

FIG. 5 is a view showing a condition that the head set levers 21 are in a released position and the needle shifting lever 22 is in a retracted position to permit the mounting and dismounting of the print cartridge 3. In this case, the needle holding member 30 is located at a most retracted position in FIG. 5 by the needle shifting lever 22, thereby widening an inlet for mounting the print cartridge 3. From this condition, when the needle shifting lever 22 is rotated around the shaft 22*a* in an anti-clockwise direction, as shown in FIGS. 8A to 8C, the needle holding member 30 is slid to the left via the rink 23 as the needle shifting lever 22 is rotated, thereby being shifted to a position shown in FIG. 8C. In this case, the ink needles 31 of the needle holding member 30 are most advanced to the left.

Next, a procedure for mounting and dismounting the print cartridge 3 with respect to the carriage 2 will be explained with reference to FIGS. 9A to 9C and FIGS. 10A to 10C.

When the print cartridge 3 is mounted on the carriage 2, the head set levers 21 and the needle shifting lever 22 of the carriage 2 are positioned at positions shown in FIGS. 5 and 9A. That is to say, the needle holding member 30 is positioned at the position most retarded to the right by the needle shifting lever 22, thereby widening the inlet for mounting the print cartridge 3. In this condition, the print cartridge 3 is rested on the cartridge housing portion 2B from the above shown by the arrow in FIG. 5. Then, the head set levers 21 rotatably supported on the shafts 21*a* of the carriage 2 are rotated in a clockwise direction.

By predetermined rotational angle of the head set levers 21, as shown in FIG. 9B, the head set plates 21*b* of the head set levers 21 abut against the inclined surfaces 18*a* formed on the upper surfaces of both side walls of the print cartridge 3. When the head set levers 21 are further rotated, the head set plates 21*a* urge the inclined surfaces 18*a* of the print cartridge 3 by the action of the biasing springs 21*c*, with the result that the print cartridge 3 is guided to the predetermined mounting position on the carriage 2 and the positioning surfaces 19*a* of the print cartridge 3 are urged against the positioning members 20*a* of the carriage 2 thereby to position the print cartridge 3. Ultimately, by engaging the lock plates 21*d* of the head set levers 21 with the lock surfaces 18*b* of the print cartridge 3 and by engaging the positioning pieces 20*b* of the carriage 2 with the positioning pieces 19*b* of the print cartridge 3, the print cartridge 3 is positioned and fixed at the predetermined mounting position. In this case, the lock plates 21*d* are engaged by the lock surfaces 18*b* of the print cartridge 3, and positioning members 20*a* and the positioning pieces 20*b* of the carriage 2 are engaged by the positioning surfaces 19*a* and the positioning portions 19*b* of the print cartridge 3, thereby mounting the print cartridge 3 to the mounting position of the cartridge housing portion 2B of the carriage 2 more positively with high accuracy (refer to FIG. 9C).

Figure 10A:
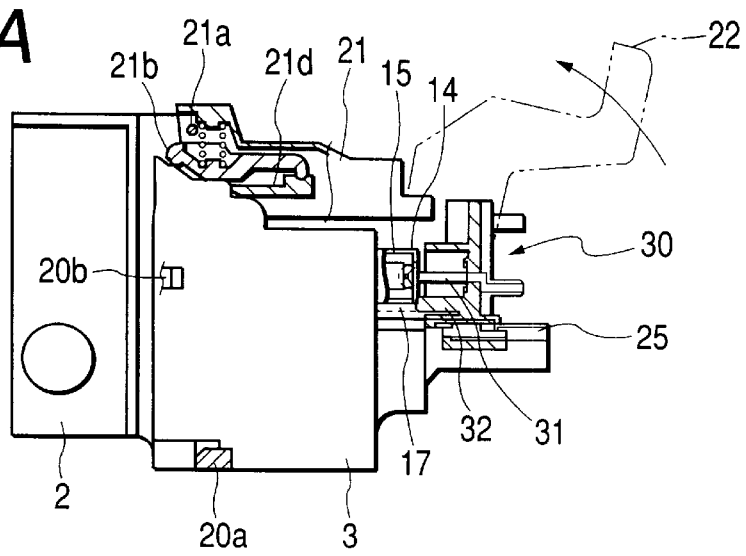
FIGS. 10A, 10B and 10C are schematic views showing sequence for connecting the ink needle in the print cartridge mounting and dismounting procedure with respect to the carriage in the liquid ejecting apparatus of the present invention.
Figure 10B:
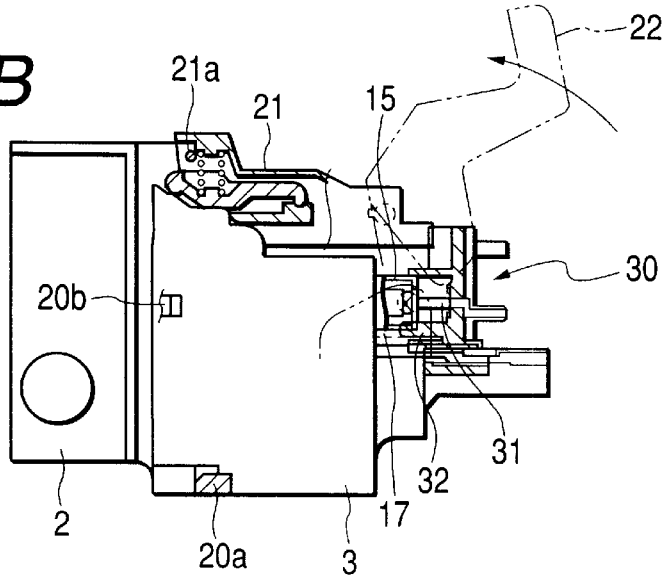
Figure 10C:
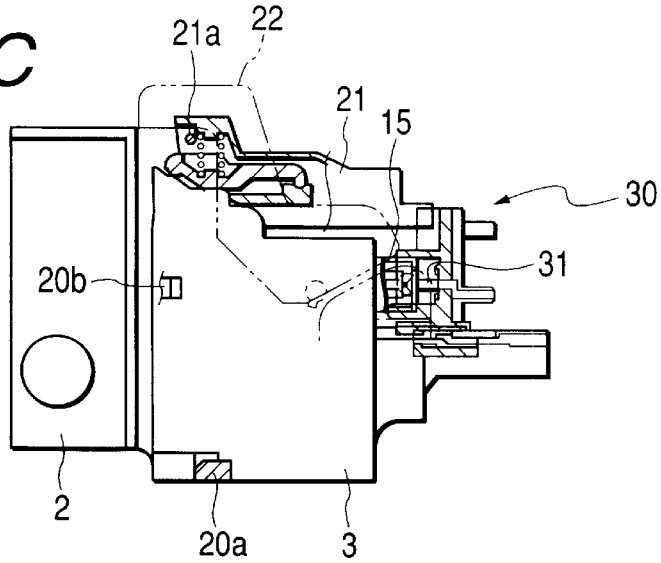

Then, as shown in FIGS. 10A and 10B, by rotating the needle shifting lever 22 rotatably supported by the carriage via the shaft 22*a* in the anti-clockwise direction, the needle holding member 30 is approached to the print cartridge via the link 23 (also refer to FIGS. 8A and 8B). When the needle shifting lever 22 is further rotated, the tip ends of the ink needles 31 on the needle holding member 30 start to be inserted into the interconnecting members 15 of the print cartridge 3. At the same time, the needle holding member 30 is guided by the inserting the guiding bosses 32 into the guiding boss holes 17 of the ink flow-in member 13, thereby penetrating the ink needles 31 into the interconnecting members 15 smoothly. The ink needles 31 are passed through the small holes 15*a* of the cylindrical interconnecting members 15 while widening the small holes and are inserted while widening the slits 16*a* of the closing films 16. As shown in FIG. 10C, when the needle shifting member 22 is rotated to a maximum rotational position, the connection between the interconnecting members 15 and the ink needles 31 are completed.

When the plural ink needles 31 of the needle holding member 30 are connected to the plural interconnecting members 15 of the print cartridge 3, respectively, by the above-mentioned procedure, the inks contained in the respective ink tanks 6 are supplied to the ink flow-in member 13 of the print cartridge 3 from the ink flow paths of the needle holding member 30 through the ink needles 31 and the respective ink supplying tubes 7 and can flow into the discharge head portion 10.

When the print cartridge 3 is dismounted from the carriage 2, a reverse procedure with respect to the aforementioned procedure may be performed.

That is to say, first of all, from the condition shown in FIG. 10C, by rotating the needle shifting lever 22 in the clockwise direction to shift the ink needles 31 (which were inserted in the interconnecting members 15 of the print cartridge 3) to the right together with the needle holding member 30, with the result that the ink needles are retracted from the interconnecting members 15 and the needle holding member 30 is shifted up to the predetermined retard position (refer to FIG. 9C).

Then, when the head set levers 21 are rotated in the anti-clockwise direction, as shown in FIG. 9A, the urging pieces 21*e* of the head set levers 21 abut against the upper surfaces of the side walls of the print cartridge 3 to urge the print cartridge toward the dismounting direction, thereby releasing the engagement condition between the print cartridge 3 and the carriage 2 to permit the dismounting of the print cartridge 3.

Figure 7A:
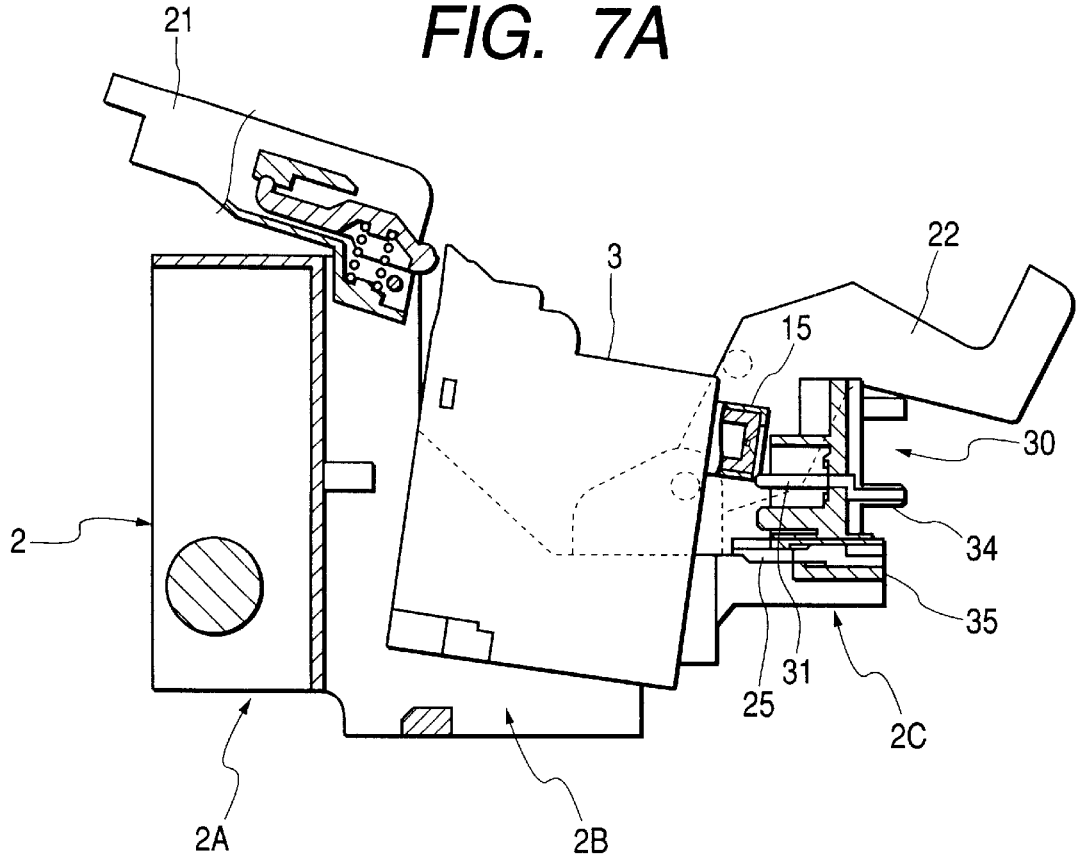
FIG. 7A is a view showing a position relationship between the ink needle and the interconnecting member of the print cartridge when the print cartridge is mounted and dismounted with respect to the carriage in the liquid ejecting apparatus of the present invention.
Figure 7B:
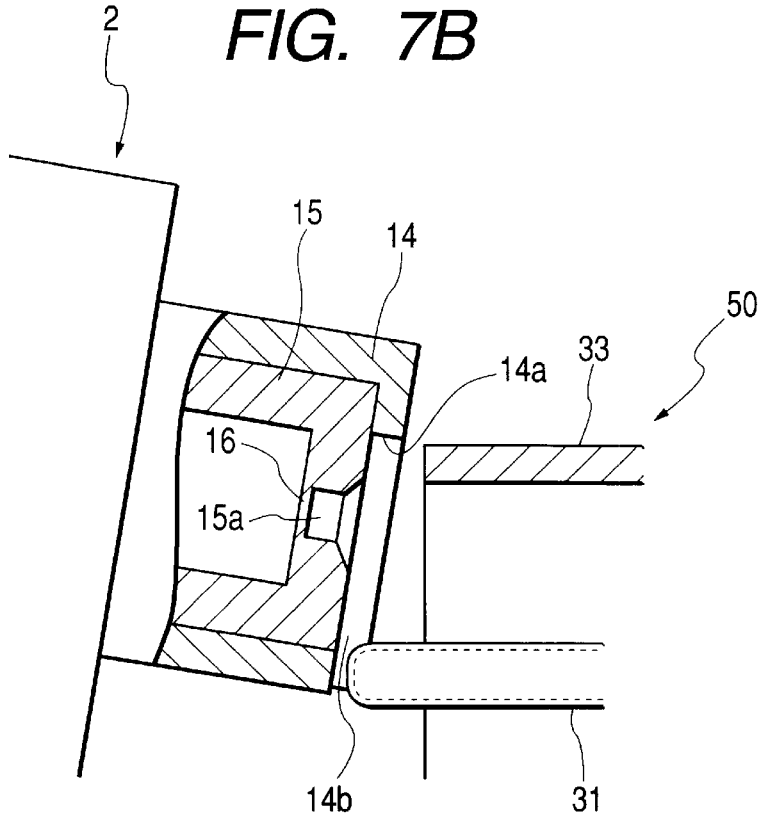
FIG. 7B is an enlarged view showing a part of FIG. 7A.

When the print cartridge 3 is mounted and dismounted with respect to the carriage 2, since the notched needle tip end avoiding configurations 14*b* are formed in the lower portions of the tip ends of the cylindrical projection portions 14 of the ink flow-in member 13 of the print cartridge 3, when the print cartridge 3 is mounted and dismounted, as shown in FIGS. 7A and 7B, the ink needles can be shifted without abutting the tip ends of the ink needles 31 against the tip ends of the cylindrical projection portions 14. Thus, the shifting amount (avoiding amount) of the needle holding member 30 for holding the ink needles 31 can be minimized, thereby contributing to the compactness of the carriage 2 and accordingly the apparatus.

As mentioned above, according to the present invention, by fitting the cylindrical interconnecting members made of rubber or soft resin and provided at their tip ends with the small holes for receiving the ink needles and the closing films having the central slits into the plural cylindrical projection portions constituting the ink flow-in member of the print cartridge and by integrally attaching the ink flow-in member to the body of the print cartridge by the vibration welding (ultrasonic welding) and the like, the connecting means for the plural ink supplying systems can be manufactured with a simple construction, and the communication of the plural ink supplying systems due to the connection between the interconnecting members and the ink needles can sealingly be effected positively with high accuracy. Further, by providing the closing films having the slits, the ink in the print cartridge can be prevented from leaking from the liquid discharge ports, and the drying and flow-out of the ink and the entering of the external dirt can be prevented, and, upon the insertion of the ink needles, the smooth passage of the ink needles is permitted by being deformed by abutment against the tip ends of the needles. Further, in this case, since the needles are passed through and retracted from the slits of the closing films in the condition that the ink needles are sealed by the small holes, the ink is not scattered into the interior and exterior of the apparatus.

Further, by providing the notched ink needle tip end avoiding configurations for avoiding the contact with the tip ends of the ink needles at the tip ends of the cylindrical projection portions of the ink flow-in member of the print cartridge, the shifting amount (avoiding amount) of the needle holding member required when the print cartridge is mounted and dismounted can be reduced, thereby making compactness of the structure for shifting the needle holding member and the compactness of the main body of the printer possible.

What is claimed is:

1. A liquid ejecting apparatus, comprising:

a print cartridge having a discharge head portion for discharging a liquid droplet, the print cartridge being detachably mounted on a carriage; and an ink supplying and connecting mechanism for detachably connecting and communicating an ink needle connected to a tube side with an interconnecting member of a print cartridge side so that ink can be supplied from an ink tank to the print cartridge through a tube, wherein:

said print cartridge comprises said discharge head portion for discharging the liquid droplet in response to a received electrical signal;

a sub-tank for temporarily storing the ink to be supplied to said discharge head portion;

a cartridge body portion for forming an ink flow path for connecting said sub-tank to said discharge head portion; and an ink flow-in member having a cylindrical projection portion into which said interconnecting member is fit, the interconnecting member being formed from a soft material and being for receiving the ink from said ink tank by inserting said ink needle connected to the tube side into said interconnecting member, and the interconnecting member having a small hole and a closing film having a slit formed at an ink needle inserting tip end of said interconnecting members, wherein the small hole of said interconnecting member has an inner diameter smaller than an outer diameter of said ink needle.

2. A liquid ejecting apparatus according to claim 1, wherein a length of the small hole of said interconnecting member in an ink needle inserting direction is greater than 1 mm and a thickness of said closing film is equal to or greater than 0.2 mm and equal to or smaller than 1 mm.

3. A liquid ejecting apparatus according to claim 1, wherein a length of the small hole of said interconnecting member in an ink needle inserting direction is greater than 1 mm and a thickness of said closing film is equal to or greater than 0.2 mm and equal to or smaller than 1 mm.

4. A liquid ejecting apparatus according to any one of claims 1, 2 or 3, wherein an ink needle inserting tip end of the small hole of said interconnecting member is tapered.

5. A liquid ejecting apparatus according to any one of claims 1, 2 or 3, wherein a needle tip end avoiding configuration is provided at a tip end of said cylindrical projection portion of said ink flow-in member.

6. A liquid ejecting apparatus according to any one of claims 1, 2 or 3, wherein said ink flow-in member has a flat plate-shaped portion joined to said cartridge body portion to form the ink flow path to said sub-tank and said flat plate-shaped portion is joined to said cartridge body portion by vibration welding.

7. A liquid ejecting apparatus according to any one of claims 1, 2 or 3, wherein said ink needle is held by a needle holding member shiftably provided on said carriage so that said ink needle can be insertion-connected to and detached from said interconnecting member of said print cartridge.

8. A liquid ejecting apparatus according to claim 7, wherein said needle holding member is shifted toward and away from said print cartridge by a needle shifting lever rotatably supported on said carriage.

9. A liquid ejecting apparatus according to any one of claims 1, 2 or 3, wherein said ink flow-in member is provided with a plurality of interconnecting members, and a plurality of ink needles are provided in correspondence to said respective interconnecting members.

10. A liquid ejecting apparatus according to any one of claims 1, 2 or 3, wherein, when said ink needle is insertion-connected to said interconnecting member of said print cartridge, said ink needle is passed through said slit of said closing film in a condition that said ink needle is sealed by the small hole of said interconnecting member.

11. A liquid ejecting apparatus according to any one of claims 1, 2 or 3, wherein, when said ink needle is detached from said interconnecting member of said print cartridge, said ink needle is passed through said slit of said closing film in a condition that said ink needle is sealed by the small hole of said interconnecting member.

12. An elastic connecting member for supplying liquid, the elastic connecting member being arranged at an end portion of a route for transporting the liquid, wherein a needle is inserted into the connecting member to enable transportation of the liquid, the elastic member comprising:

an opening having a beginning end at one side surface, and a terminal end at a midway thickness of the connecting member, a depth of the opening being $t_2$; and a slit provided through the connecting member from the terminal end of the opening to an other side surface of the connecting member, the slit having a depth $t_1$, wherein, the depth $t_2$ of the opening and the depth $t_1$ of the slit satisfy $t_1<t_2$.

13. An ink retaining member, comprising:

a retaining portion for retaining ink;

a liquid supply route communicating with the retaining portion; and a connecting member arranged at an end portion of the liquid supply route, wherein, the connecting member is provided with an opening having a depth $t_2$ and having a beginning end at one side surface of the connecting member, into which a needle having a diameter D is inserted, and a terminal end at a midway thickness of said connecting member, and having a slit with a depth $t_1$ provided from the terminal end of the opening to an other side surface of the connecting member which faces the liquid supply route, wherein the depth $t_2$ and the depth $t_1$ satisfy $t_1<t_2$, and wherein, a diameter d of the terminal end of the opening and the diameter D of the needle satisfy D>d.

14. An ink retaining member according to claim 13, wherein the opening is provided with a tapered area where an opening diameter decreases from the beginning end toward the terminal end, the tapered area extending from at least a part of the depth $t_2$ of the opening.

* * * * *

UNITED STATES PATENT AND TRADEMARK OFFICE

CERTIFICATE OF CORRECTION

PATENT NO. : 6,631,982 B2
DATED : October 14, 2003
INVENTOR(S) : Toshihiro Sasaki et al.

It is certified that error appears in the above-identified patent and that said Letters Patent is hereby corrected as shown below:

Title page,
Insert Item -- [30] Foreign Application Priority Data
Feb. 9, 2001 (JP) Japan ……2001-033608
Feb. 8, 2002 (JP) Japan 2002-032356 --.

Column 1,
Line 61, "injecting" should read -- ejecting --.

Column 3,
Line 18, "preferable" should read -- perferably --; and
Line 33, "shafting" should read -- shifting --.

Column 7,
Line 64, "(d) 2.2" should read -- (d)=2.2 --; and
Line 66, "with" should read -- without --.

Column 9,
Line 56, "rink" should read -- link --.

Signed and Sealed this

Nineteenth Day of April, 2005

JON W. DUDAS
*Director of the United States Patent and Trademark Office*